US010518940B2

(12) United States Patent
Vanon

(10) Patent No.: US 10,518,940 B2
(45) Date of Patent: Dec. 31, 2019

(54) METAL CONTAINER COMPRISING A NECK CAPABLE OF RECEIVING A SCREW CAP-TYPE SEALING ELEMENT

(71) Applicant: ARDAGH MP WEST FRANCE, Paris (FR)

(72) Inventor: Luc Jean-Pierre Vanon, Lentiol (FR)

(73) Assignee: ARDAGH MP WEST FRANCE, Paris (FR)

( * ) Notice: Subject to any disclaimer, the term of this patent is extended or adjusted under 35 U.S.C. 154(b) by 566 days.

(21) Appl. No.: 15/129,004

(22) PCT Filed: Mar. 25, 2015

(86) PCT No.: PCT/FR2015/050763

§ 371 (c)(1),
(2) Date: Sep. 26, 2016

(87) PCT Pub. No.: WO2015/145074

PCT Pub. Date: Oct. 1, 2015

(65) Prior Publication Data

US 2017/0107020 A1 Apr. 20, 2017

(30) Foreign Application Priority Data

Mar. 26, 2014 (FR) ..... 14 52568

(51) Int. Cl.

| | |
|---|---|
| ***B65D 1/02*** | (2006.01) |
| ***B67B 3/18*** | (2006.01) |
| ***B65D 41/34*** | (2006.01) |

(52) U.S. Cl.

CPC ..... *B65D 41/348* (2013.01); *B65D 1/0246* (2013.01); *B67B 3/18* (2013.01); *B65D 1/0223* (2013.01); *B65D 41/3447* (2013.01)

(58) Field of Classification Search

CPC ..... B65D 41/348; B65D 41/3447; B65D 1/0246; B65D 1/0223; B65D 1/023;

(Continued)

(56) References Cited

U.S. PATENT DOCUMENTS 2,337,616 A * 12/1943 Mcmanus ..... B65D 7/48 220/259.3
2,409,788 A * 10/1946 Osborne ..... B67B 3/18 53/488

(Continued)

FOREIGN PATENT DOCUMENTS

| | | |
|---|---|---|
| JP | 2001-010627 | 1/2001 |
| WO | 2012/133391 | 10/2012 |

OTHER PUBLICATIONS

International Search Report, dated Jul. 9, 2015, from corresponding PCT application.

*Primary Examiner* — Gideon R Weinerth
(74) *Attorney, Agent, or Firm* — Young & Thompson

(57) ABSTRACT

Disclosed is a metal container including a neck, wherein a screw thread and a ring collar are provided. The screw thread: —includes a top radius between 0.85 and 1.2 mm and a bottom radius between 0.5 and 0.7 mm; —the lower flank of the ring collar, which diverges from the top flank in the direction of the longitudinal axis, defines an angle of between 20° and 30° relative to a plane perpendicular to the longitudinal axis; —the outer rim of the bottom flank of the ring collar has a radius between 0.7 and 0.9 mm, and—the inner rim of the lower flank of the ring collar is provided at a distance of between 13 and 15 mm relative to the free rim of the neck.

14 Claims, 2 Drawing Sheets

Figure 1:
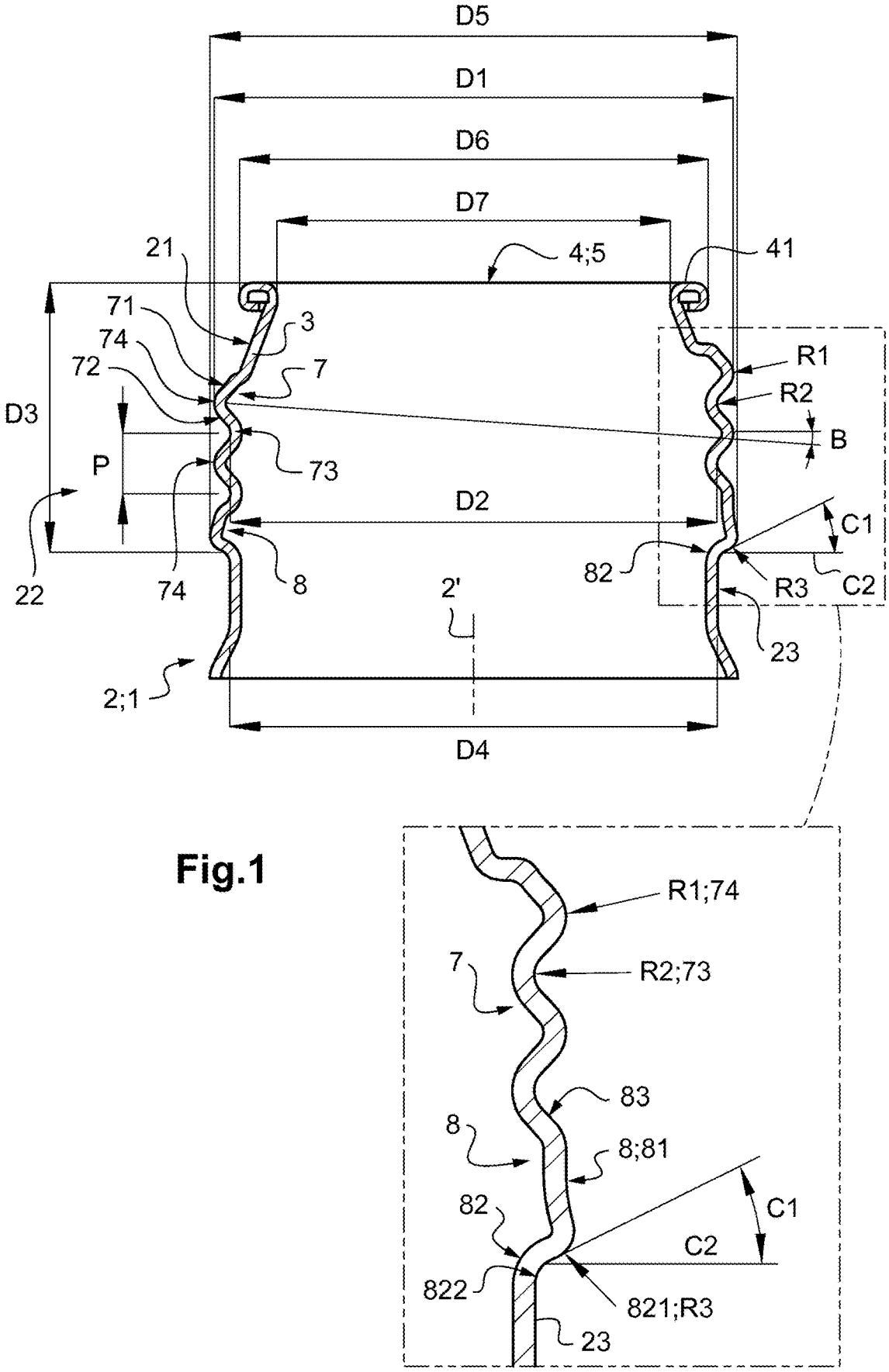

(58) Field of Classification Search
CPC ..... B65D 1/0207; B67B 3/16; B67B 3/18; B67B 3/20; B67B 3/2006; B67B 3/2013; B67B 3/204; Y10S 72/715
USPC ..... 72/379.4, 103, 105, 715; 220/288, 669, 220/259.3, 906; 215/40, 42, 44, 252
See application file for complete search history.

(56) References Cited

U.S. PATENT DOCUMENTS 2,444,506 A * 7/1948 Hammer ..... B21D 51/44 413/10
3,537,234 A * 11/1970 Mayer ..... B21D 51/50 53/357
3,861,551 A * 1/1975 Hannon ..... B21D 51/50 215/252
5,293,765 A * 3/1994 Nussbaum-Pogacnik ..... B21D 51/24 72/103
5,704,240 A * 1/1998 Jordan ..... B21D 15/04 72/103
5,718,352 A * 2/1998 Diekhoff ..... B21D 51/26 215/44
7,147,123 B2 * 12/2006 Yamashita ..... B65D 41/045 220/366.1
7,905,130 B2 * 3/2011 Marshall ..... B21D 51/2615 72/104
8,016,148 B2 * 9/2011 Walsh ..... B65D 1/0207 215/44
8,167,161 B2 * 5/2012 Ichimura ..... B65D 41/045 215/307
8,496,131 B2 * 7/2013 Forrest ..... B65D 1/0246 215/317
9,149,856 B2 * 10/2015 Hosoi ..... B21D 51/2615
2003/0046971 A1 * 3/2003 Enoki ..... B21D 22/30 72/348
2005/0067365 A1 * 3/2005 Hanafusa ..... B65D 1/0246 215/43
2005/0115294 A1 * 6/2005 Kanou ..... B65D 1/0223 72/121
2006/0071007 A1 * 4/2006 Tsutsumi ..... B65D 41/14 220/713
2007/0062952 A1 * 3/2007 Kobayashi ..... B21D 51/50 220/288
2009/0211329 A1 * 8/2009 Hanafusa ..... B21D 51/38 72/379.4
2012/0269602 A1 10/2012 Hanafusa et al.
2014/0061212 A1 * 3/2014 Jacober ..... B65D 17/4012 220/669
2015/0013416 A1 * 1/2015 Hosoi ..... B21D 51/38 72/68
2017/0107020 A1 * 4/2017 Vanon ..... B65D 1/0246
2017/0320637 A1 * 11/2017 Jones ..... B65D 1/0207
2018/0229900 A1 * 8/2018 Ross ..... B65D 41/3466
2019/0084728 A1 * 3/2019 Bonfoey ..... B65D 41/3438

* cited by examiner

METAL CONTAINER COMPRISING A NECK CAPABLE OF RECEIVING A SCREW CAP-TYPE SEALING ELEMENT

TECHNICAL FIELD TO WHICH THE INVENTION RELATES

The present invention relates to the metal containers comprising a threaded neck adapted to receive a sealing element of the screw cap type.

TECHNOLOGICAL BACK-GROUND

Some containers include a threaded neck that allows the sealed closing thereof by a screw cap (or screw plug).

Such a screw cap is conventionally formed of a top cover consisted of a sealing disc extended by a cylindrical skirt, this skirt being ended by a ring acting as an opening indicator.

The threaded neck of the container conventionally comprises:

- at least one thread adapted to cooperate with the top cover of the screw cap, provided with a complementary thread, and
- a ring collar arranged under the thread and adapted to cooperate with the ring of the screw cap.

The glass bottles are particularly adapted to such screw caps: they allow the use of standard metal caps that are mounted by means of single beading/threading head seaming machines.

As for them, the current metal containers may also be equipped with metal screw caps (as described for example in the document US-2012/0269602); but their structure requires the use of specific caps that force the mounting thereof by means of complex seaming machines (referred to as "double beading/threading head" machines).

To avoid this constraint, a need exists about a metal container that would be able to receive a standard screw cap in a tight (in particular, gas tight) manner, and adapted to be placed by means of a single beading/threading head seaming machine.

OBJECT OF THE INVENTION

The present invention hence relates to a metal container whose neck includes a specific thread that has for interest to be able/suitable to receive standard metal screw caps and able to be placed by means of a single beading/threading head seaming machine.

For that purpose, the metal container according to the invention comprises a neck defining a longitudinal axis, which neck includes a wall of constant thickness, or at least approximately constant, which is ended by a free edge delimiting an orifice and in which are arranged at least two beads:

- a first bead forming at least one thread, and
- a second, convex bead forming a ring collar (or counter ring), arranged between said thread and a neck base.

This ring collar includes a lateral face extended by a lower flank and by an upper flank, which lower flank is delimited by a rounded external edge and a rounded internal edge, connected to said lateral face and to said neck base, respectively.

And, according to the present invention:

a) said thread includes:

- a1) a cross-section radius at the crest comprised between 0.85 and 1.2 mm, preferably of 1 mm+/−0.05 mm, and

- a2) a cross-section radius at the root (or bed) comprised between 0.5 and 0.7 mm, preferably of 0.6 mm+/−0.05 mm, b) the lower flank of the ring collar, diverging with respect to the upper flank towards the longitudinal axis, defines an angle comprised between 20° and 30° (preferably between 22° and) 30° with respect to a plane perpendicular to the longitudinal axis, c) the external edge of the lower flank of the ring collar has a cross-section radius comprised between 0.7 and 0.9 mm, preferably of 0.8 mm+/−0.05 mm, and d) the internal edge of the lower flank of the ring collar is arranged at a distance comprised between 13 and 15 mm, preferably of 14.3 mm+/−0.3 mm, with respect to said free edge of the neck.

Such a metal container has for interest to be able to receive a standard screw cap of the market, in particular a screw cap usually adapted to be placed on a thread of a glass bottle in accordance with the MCA2 standard (see "Emballage"—Volume 5—Afnor) or the XP H35-107 standard (Afnor).

The corresponding neck is also adapted to ensure the tightness and, as the case may be, to allow a deformation of the metal without damaging the internal varnishes.

Such a metal container has also for interest to allow the implementation of single beading/threading head seaming machines, for the mounting of the screw cap on its threaded neck.

According to advantageous embodiment characteristics, which can be taken in combination or independently from each other:

- the thread has a pitch comprised between 3 and 3.3 mm, and/or a number of turns comprised between 1 and 2;
- the diameter at the thread crest is comprised between 27.2 and 28.5 mm, the diameter at the thread root is comprised between 25.5 and 26.5 mm, and the diameter of the internal edge of the lower flank of the ring collar is comprised between 24 and 25.4 mm;
- the free edge of the neck is in the form of a curl (or rolled), the external diameter of which, on the one hand, is comprised between 24.5 and 25.5 mm and the internal diameter of which, on the other hand, is comprised between 20.5 and 21.5 mm;
- the thread has a helix angle comprised between 1.5° and 2.5°;
- the neck is equipped with a sealing element of the screw cap type including—a top cover provided with a bead forming a thread that is complementary of the thread formed on said neck and—a ring cooperating with the lower flank of the ring collar to form an opening indicator (or temper evident).

The present invention also relates to a method for assembling a sealing element of the screw cap type with a metal container, which method comprises the steps of:

- providing a container as defined hereinabove and a sealing element, and
- locking said sealing element to the neck of said container by means of a single beading/threading head seaming machine.

DETAILED DESCRIPTION OF AN EXEMPLARY EMBODIMENT

Figure 2:
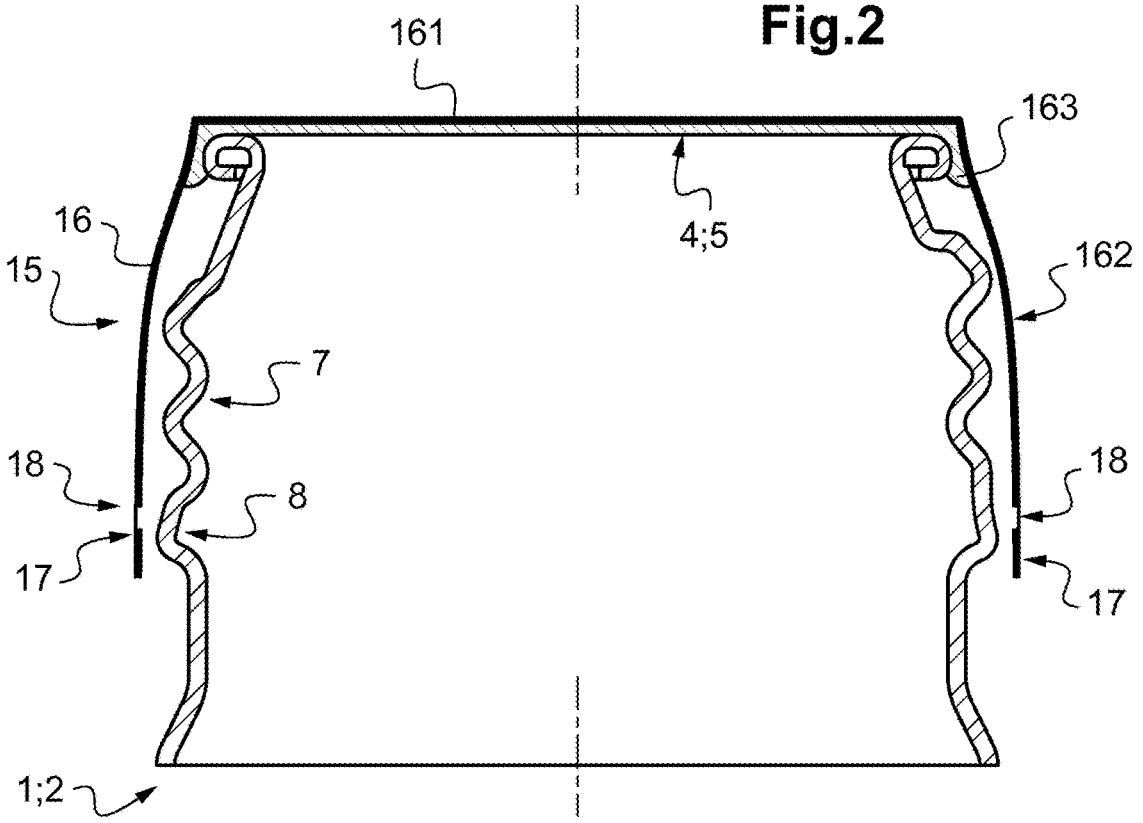
Figure 3:
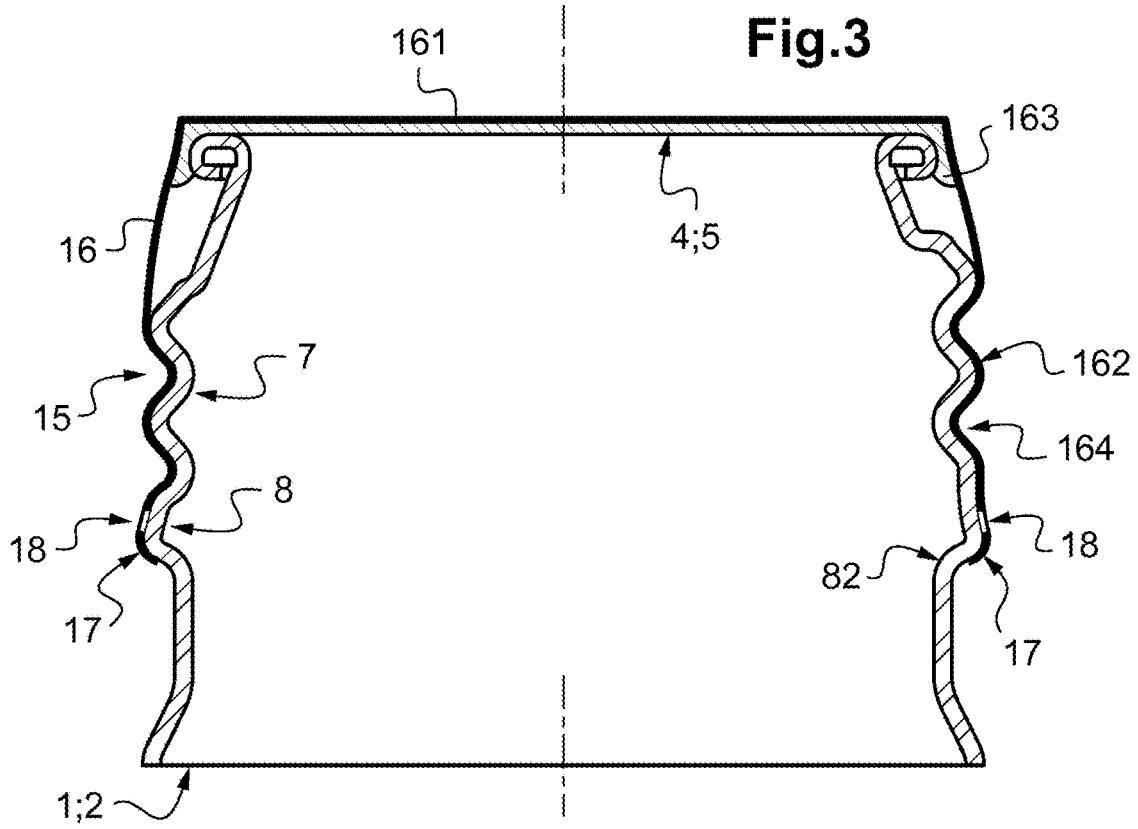

The present invention will be further illustrated, without being limited thereby, by the following description of a particular embodiment in relation with the appended drawings in which:

FIG. 1 is a cross section of the neck of a metal container according to the invention, with an amplified and partial view of this neck;

FIGS. 2 and 3 correspond to the neck of FIG. 1, before and after locking of the sealing element in the form of a screw cap.

THE METAL CONTAINER

FIGS. 1 to 3 show partially a metal container 1 according to the invention, herein with a threaded neck.

The metal container 1 advantageously consists in a container adapted to keep liquids, in particular food liquids (water, milk, wine, beer, oil, etc. . . . ) and preferably fizzy drink liable to release gas (in particular carbon dioxide).

This container 1 is made from a metal material, advantageously aluminium.

Such a metal container 1 has a general shape that is conventional per se (for example of the bottle type), i.e. it includes a body (not shown) constituting a vessel that is tightened at the top thereof and is ended by the neck 2 (herein shown in FIGS. 1 to 3).

As the case may be, the internal surface of this container 1 (including the neck 2 thereof) is coated with an internal protection layer (not shown) that is made in a product resisting to the chemical action of the product to be packed.

This protection layer advantageously consists in a layer of varnish, whose composition and thickness in particular are chosen by the one skilled in the art as a function of the product to be packed.

The Neck

As described hereinafter in relation with FIG. 1, the neck 2 of the container 1 is in the form of a cylindrical tubular part that defines a longitudinal axis 2'.

The neck 2 is formed by a metal wall 3 that has a constant, or at least approximately constant, thickness.

The thickness of this wall 3 is for example lower than 1 mm.

The neck 2 includes three successive parts, distributed over the length of the longitudinal axis 2', i.e.:

- a truncated upper part 21, converging towards the longitudinal axis 2' on the side of a free edge 4 delimiting an orifice 5 for the entry and/or the exit of the packed liquid,
- a beaded insert part 22, provided with beads intended to cooperate with a sealing element of the screw cap (or screw plug) type that will be described hereinafter in relation with FIGS. 2 and 3, and
- a base 23, herein of cylindrical general shape (advantageously of constant diameter).

The free edge 4 of the truncated upper part 21 is herein formed by a peripheral curl 41 rolled towards the outside with respect to the orifice 5.

The beaded insert part 22 of the neck 2 herein includes two beads:

- a first convex bead 7, having the aspect of a helical ridge to form a screw thread, and
- a second convex bead 8, having the aspect of an annular ridge intended to form a ring collar.

According to the invention, these two beads 7, 8 have particular characteristics that allow the mounting of a standard screw cap of the market, and that, moreover, by means of a standard single beading/threading head seaming machine.

Generally, the size parameters of the beads 7, 8 are advantageously measured from the external surface of the neck 2.

The Thread

The thread 7, described hereinafter in relation with FIG. 1, is composed of:

- two flanks, an upper one 71 (oriented on the side of the free edge 4) and a lower one 72 (opposite to the free edge 4), i.e. also the sides of the thread 7,
- a root 73, corresponding to the line of junction between the adjacent lower 72 and upper 71 flanks, and
- a crest 74, corresponding to the external line where the two flanks 71, 72 of the thread 7 join each other.

The root 73 and the crest 74 of the thread 7 are herein rounded, with a curved cross section, preferably in an arc of a circle.

According to the invention, this thread 7 is defined by a combination of particular size characteristics.

Herein, the crest 74 and the root 73 of the thread 7 have the following sizes:

- the cross-section radius R1 at the crest 74 is comprised between 0.85 and 1.2 mm; it is preferably of 1 mm±0.05 mm, and
- the cross-section radius R2 at the root 73 is comprised between 0.5 and 0.7 mm; it is preferably of 0.6 mm±0.05 mm.

The diameter D1 at the crest 74 of the thread 7 is advantageously comprised between 27.2 and 28.5 mm.

The diameter D2 at the root 73 of the thread 7 is itself comprised between 25.5 and 26.5 mm.

The thread 7 is also defined by a particular helix angle B, corresponding to the inclination of the thread 7 with respect to a plane perpendicular to the longitudinal axis 2'.

In this case, the helix angle B of the thread 7 is advantageously comprised between 1.5° and 2.5°, preferably between 2° and 2.5°.

This thread 7 has also advantageously:

- a pitch P comprised between 3 and 3.3 mm and
- a number of turns comprised between 1 and 2.

The Ring Collar

The ring collar 8, described hereinafter in relation with FIG. 1, is composed of a lateral face 81 extended by two flanks, a lower one 82 (opposite to the free edge 4) and an upper one 83 (on the side of the free edge 4).

The lateral face 81 has herein a truncated cone general shape, converging towards the longitudinal axis 2' on the side of the free edge 4 of the neck 2.

The flanks 82 and 83 of this ring collar 8 have herein a truncated cone general shape, diverging relative to each other towards the longitudinal axis 2'.

In particular, the lower flank 82 of the ring collar 8 is delimited by a rounded external edge 821 and by a rounded internal edge 822, connected to the lateral face 81 of the ring collar 8 and to the base 23 of the neck 2, respectively.

According to the invention, the ring collar 8 is defined by a combination of particular size characteristics.

The lower flank 82 of the ring collar 8 defines an angle C1 comprised between 20° and 30° (preferably between 22° and 30°) with respect to a plane C2 perpendicular to the longitudinal axis 2' of the neck 2.

This lower flank 82 is ascending, from the rounded internal edge 822 towards the rounded external edge 821, on the side of the free edge 4 of the neck 2.

The external edge 821 of the lower flank 82 has a cross-section radius R3 comprised between 0.7 and 0.9 mm; this radius R3 is preferably of 0.8 mm+/−0.05 mm.

The internal edge 822 of the lower flank 82 is arranged at a distance D3 comprised between 13 and 15 mm with respect to the free edge 4 of the neck 2; this distance D3 is preferably of 14.3 mm+/−0.3 mm.

This internal edge 822 of the lower flank 82 also defines a diameter D4 (corresponding to the diameter of the base 23 of the neck 2) advantageously comprised between 24 and 25.4 mm.

The external edge 821 of this lower flank 82 itself defines a diameter D5 advantageously comprised between 27.5 and 28.5 mm.

The Curl of the Free Edge of the Neck

The curl of the free edge 4 of the neck 2 has the following sizes:

- an external diameter D6 comprised between 24.5 and 25.5 mm, and
- an internal diameter D7 comprised between 20.5 and 21.5 mm.

Bead of the Neck

The beads 7 and 8 of the neck 2 may be performed by means of a standard tool that is subjected to a modification on the profile part of the active tools (wheels adapted by their shapes and their radii) in order to obtain suitable results in terms of tightness, seaming, torque of opening of the screw cap, while being compatible with the method and the integrity of the internal varnishes.

The Sealing Element

A sealing element 15 of the screw cap type, advantageously standard, is placed on the neck 2 of this container 1 as illustrated in FIGS. 2 and 3.

Such a screw cap 15 is advantageously in accordance with the MCA2 standard (see "Emballage"—Volume 5—Afnor) or the XP H35-107 standard (Afnor).

It is for example made from aluminium covered with a varnish, with a thickness comprised for example between 0.2 and 0.25 mm.

This screw cap 15 is composed, in a manner conventional per se, of two elements:

- a top cover 16, intended to ensure the closing of this content 1 and to cover the thread 7 of the neck 2, and
- a degradable ring 17, intended to maintain the top cover 16 before the first opening and to serve as an opening indicator.

The top cover 16 is composed in particular of:

- a sealing disc 161, of generally circular shape, intended to cover the free edge 4 of the neck 2 and to seal the orifice 5 of the neck 2, and
- a cylindrical skirt 162, connected to the edge of the sealing disc 161 and intended to come opposite to the beaded insert part 22 to cooperate with the thread 7 of the neck 2.

The lower face of this sealing disc 161 is provided with a peripheral annular gasket 163 that is intended to cover the free edge 4 of the neck 2 to ensure the tightness.

The skirt 162 consists in a tubular part that, originally, has no thread (FIG. 2).

The ring 17 itself consists in an annular lower band, extending the skirt 162, on the side opposite to the sealing disc 161.

This ring 17 may be consisted of one or several sections, fastened together by fracture initiation means (also called line of less resistance or line of weakness).

Fracture initiation means 18, for example a degradable line (or "line of less resistance" or "line of weakness") are arranged between the top cover 16 and the ring 17.

These fracture initiation means 18 are consisted for example by a set of bridges, regularly distributed over the circumference of the skirt 162 and of the ring 17 of this screw cap 15.

Mounting of the Sealing Element on the Neck of the Container

The container 1 according to the invention is filled with the liquid of interest through its opening 5.

The screw cap 15, whose skirt 162 of the top cover 16 is not beaded, is suitably press fitted on the neck 2 of the container 1 (FIG. 2).

That way, the screw cap 15 is arranged so that:

- the top cover 16 covers the orifice 5, the thread 7 of the neck 2 and an upper part of the ring collar 8, and
- the ring 17 covers a lower part of the ring collar 8 of the neck 2.

The screw cap 15 is then locked to the neck 2 of the container 1, by a standard beading/threading method that is met in particular in the glass bottles.

For that purpose, the screw cap 15 is directly beaded/threaded on the neck 2 of the container 1, advantageously by a wheel-based forming tool that gives it its shape by direct pressure on the longitudinal axis 2'.

As illustrated in FIG. 3, during this shaping:

- the skirt 162 of the top cover 16 is beaded/threaded to form a thread 164 whose shape is complementary of the thread 7 formed on the neck 2, and
- the lower edge of the ring 17 is curved so as to cover the lower flank 82 of the ring collar 8 of the neck 2.

This locking operation is advantageously performed by means of a single beading/threading head seaming machine (contrary to the current neck of the metal bottle requiring a double head machine operating in two successive sequences of beading).

Generally, the neck 2 may equip any metal container other than a metal bottle.

Generally, as illustrated hereinabove, such a metal container has for interest (i) to be able to receive a standard screw cap of the market and (ii) to allow the implementation of standard simple beading/threading head seaming machines to lock the screw cap on the threaded neck thereof.

The invention claimed is:

1. A metal container comprising a neck defining a longitudinal axis, wherein said neck includes a wall of constant, or at least approximately constant, thickness which is ended by a free edge delimiting an orifice and in which are arranged at least two beads:

- a first bead forming at least one thread, and
- a second, convex bead forming a ring collar arranged between said thread and a neck base,
- wherein said ring collar includes a lateral face extended by two flanks, a lower flank and an upper flank, and said lower flank is delimited by a rounded external edge and by a rounded internal edge, connected to said lateral face and to said neck base, respectively, wherein:

a) said thread includes:

a1) a cross-section radius at a crest comprised between 0.85 and 1.2 mm, and a2) a cross-section radius at a root comprised between 0.5 and 0.7 mm, b) the lower flank of the ring collar, diverging with respect to the upper flank towards the longitudinal axis, defines an angle comprised between 20° and 30° with respect to a plane perpendicular to the longitudinal axis, c) the external edge of the lower flank of the ring collar has a cross-section radius comprised between 0.7 and 0.9 mm, and d) the internal edge of the lower flank of the ring collar is arranged at a distance comprised between 13 and 15 mm with respect to said free edge of the ring.

2. The metal container according to claim 1, wherein the thread includes a crest radius of 1 mm+/−0.05 mm and a bottom radius of 0.6 mm+/−0.05 mm, the lower flank of the ring collar defines an angle comprised between 22° and 30° with respect to the plane perpendicular to the longitudinal axis, the cross-section radius of the external edge of the lower flank of the ring collar is of 0.8 mm+/−0.05 mm, and the internal edge of the lower flank of the ring collar is arranged at a distance of 14.3 mm+/−0.3 mm with respect to a free edge of said neck.

3. The metal container according to claim 1, wherein the thread has:

a pitch comprised between 3 and 3.3 mm, and/or a number of turns comprised between 1 and 2.

4. The metal container according to claim 1, wherein the diameter at the thread crest is comprised between 27.2 and 28.5 mm, the diameter at the thread root is comprised between 25.5 and 26.5 mm, and the diameter of the internal edge of the lower flank of the ring collar is comprised between 24 and 25.4 mm.

5. The metal container according to claim 1, wherein the free edge of the neck is in the form of a curl, an external diameter of the curl being between 24.5 and 25.5 mm, and an internal diameter of the curl being between 20.5 and 21.5 mm.

6. The metal container according to claim 1, wherein the thread has a helix angle comprised between 1.5° and 2.5°.

7. The metal container according to claim 1, wherein the neck is equipped with a sealing element of the screw cap type including a top cover provided with a bead forming a thread that is complementary of the thread formed on said neck, and a ring cooperating with the lower flank of the ring collar to form an opening indicator.

8. A method for assembling a sealing element with a metal container, comprising the steps of:

providing a container according to claim 1 and a sealing element of the screw cap type, and locking said sealing element to the neck of said container by means of a single beading/threading head seaming machine.

9. A method for assembling a sealing element with a metal container, comprising the steps of:

providing a container according to claim 2 and a sealing element of the screw cap type, and locking said sealing element to the neck of said container by means of a single beading/threading head seaming machine.

10. A method for assembling a sealing element with a metal container, comprising the steps of:

providing a container according to claim 3 and a sealing element of the screw cap type, and locking said sealing element to the neck of said container by means of a single beading/threading head seaming machine.

11. A method for assembling a sealing element with a metal container, comprising the steps of:

providing a container according to claim 4 and a sealing element of the screw cap type, and locking said sealing element to the neck of said container by means of a single beading/threading head seaming machine.

12. A method for assembling a sealing element with a metal container, comprising the steps of:

providing a container according to claim 5 and a sealing element of the screw cap type, and locking said sealing element to the neck of said container by means of a single beading/threading head seaming machine.

13. A method for assembling a sealing element with a metal container, comprising the steps of:

providing a container according to claim 6 and a sealing element of the screw cap type, and locking said sealing element to the neck of said container by means of a single beading/threading head seaming machine.

14. A method for assembling a sealing element with a metal container, comprising the steps of:

providing a container according to claim 7 and a sealing element of the screw cap type, and locking said sealing element to the neck of said container by means of a single beading/threading head seaming machine.

* * * * *